US008403457B2

(12) United States Patent
Frazier et al.

(10) Patent No.: US 8,403,457 B2
(45) Date of Patent: Mar. 26, 2013

(54) WASTE INK RECLAMATION APPARATUS FOR LIQUID INK RECIRCULATION SYSTEM

(75) Inventors: Isaac S. Frazier, Portland, OR (US); David P. Platt, Newberg, OR (US); Daniel Clark Park, West Linn, OR (US)

(73) Assignee: Xerox Corporation, Norwalk, CT (US)

( * ) Notice: Subject to any disclaimer, the term of this patent is extended or adjusted under 35 U.S.C. 154(b) by 203 days.

(21) Appl. No.: 13/020,864

(22) Filed: Feb. 4, 2011

(65) Prior Publication Data

US 2012/0200636 A1 Aug. 9, 2012

(51) Int. Cl.
*B41J 2/165* (2006.01)

(52) U.S. Cl. ..... 347/36

(58) Field of Classification Search ..... 347/22, 347/30, 35, 36
See application file for complete search history.

(56) References Cited

U.S. PATENT DOCUMENTS

| | | | |
|---|---|---|---|
| 4,256,470 | A | 3/1981 | Zajicek et al. |
| 4,314,264 | A | 2/1982 | Bok et al. |
| 4,320,407 | A | 3/1982 | Goldis et al. |
| 4,336,037 | A | 6/1982 | Goldis et al. |
| 4,460,903 | A | 7/1984 | Guenther et al. |
| 4,460,904 | A | 7/1984 | Oszczakiewicz et al. |
| 4,658,268 | A | 4/1987 | Needham |
| 4,792,292 | A | 12/1988 | Gaenzle |
| 5,126,752 | A | 6/1992 | Weinberg |
| 5,296,875 | A | 3/1994 | Suda |
| 5,691,753 | A | 11/1997 | Hilton |
| 5,956,062 | A | 9/1999 | Omata et al. |
| 6,139,136 | A | 10/2000 | Mackay et al. |
| 6,145,954 | A | 11/2000 | Moore |
| 6,193,363 | B1 | 2/2001 | Kelly |
| 6,196,668 | B1 | 3/2001 | Bode |
| 6,296,353 | B1 | 10/2001 | Thielman et al. |
| 6,302,516 | B1 | 10/2001 | Brooks et al. |
| 6,324,898 | B1 | 12/2001 | Cote et al. |
| 6,454,835 | B1 | 9/2002 | Baumer |
| 6,513,918 | B1 | 2/2003 | Faisst et al. |
| 6,517,189 | B2 | 2/2003 | Ogawa et al. |
| 6,578,948 | B2 | 6/2003 | Shima |
| 6,698,870 | B2 | 3/2004 | Gunther |
| 6,799,842 | B2 | 10/2004 | Barinaga et al. |
| 6,955,423 | B2 | 10/2005 | Rodriquez Mojica et al. |
| 6,997,972 | B2 | 2/2006 | Tseng |
| 7,104,637 | B1 | 9/2006 | Van Steenkiste |
| 7,150,519 | B2 | 12/2006 | Kono et al. |
| 7,316,467 | B2 * | 1/2008 | Toki ..... 347/36 |
| 7,449,051 | B2 | 11/2008 | Olsen |
| 7,455,387 | B2 * | 11/2008 | Cunnington et al. ..... 347/36 |
| 7,597,430 | B2 | 10/2009 | Umeda |
| 7,611,568 | B2 | 11/2009 | Kang et al. |
| 7,621,982 | B2 | 11/2009 | Kang et al. |
| 7,625,080 | B2 | 12/2009 | Hess et al. |
| 2003/0067518 | A1 | 4/2003 | Ishinaga et al. |
| 2005/0146582 | A1 | 7/2005 | Platt et al. |
| 2005/0151798 | A1 | 7/2005 | Merz et al. |

(Continued)

*Primary Examiner* — Lamson Nguyen
(74) *Attorney, Agent, or Firm* — Maginot, Moore & Beck, LLP

(57) ABSTRACT

An ink reclamation receptacle receives ink purged from an inkjet printing apparatus. Ink in the reclamation receptacle wets a porous membrane positioned in the reclamation receptacle, and flows into a flow channel. Negative pressure applied to a port that is placed in fluid communication with the flow channel withdraws ink from the flow channel for use in the inkjet printing apparatus, while ink wetting the pores in the membrane resists a flow of air into the flow channel.

6 Claims, 9 Drawing Sheets

U.S. PATENT DOCUMENTS

| | | | |
|---|---|---|---|
| 2006/0152558 | A1 | 7/2006 | Hoisington |
| 2007/0081043 | A1 | 4/2007 | Silverbrook |
| 2008/0007601 | A1 | 1/2008 | Tsai et al. |
| 2008/0122901 | A1 | 5/2008 | Platt et al. |
| 2008/0273071 | A1 | 11/2008 | Brown et al. |
| 2008/0297577 | A1 | 12/2008 | Wouters et al. |
| 2009/0322831 | A1 | 12/2009 | Emerton et al. |
| 2010/0097417 | A1 | 4/2010 | Hill |

* cited by examiner

WASTE INK RECLAMATION APPARATUS FOR LIQUID INK RECIRCULATION SYSTEM

TECHNICAL FIELD

This disclosure relates generally to systems that supply and recover fluid from a device, and more particularly, to an inkjet printer configured to supply liquid ink to an ink reservoir within an inkjet printing apparatus and recover liquid ink from a receptacle associated with the inkjet printing apparatus.

BACKGROUND

Fluid transport systems are well known and used in a number of applications. One specific application of transporting a fluid in a machine is the transportation of ink in a printer. Common examples of inks include aqueous inks and phase change or solid inks. Aqueous inks remain in a liquid form when stored prior to being used in imaging operations. Solid ink or phase change inks typically have a solid form, either as pellets or as ink sticks of colored cyan, yellow, magenta and black ink, that are inserted into feed channels in a printer through openings to the channels. After the ink sticks are fed into the printer, they are urged by gravity or a mechanical actuator to a heater assembly of the printer. The heater assembly includes a heater and a melt plate. The heater, which converts electrical energy into heat, is positioned proximate the melt plate to heat the melt plate to a temperature that melts an ink stick coming into contact with the melt plate. The melt plate may be oriented to drip melted ink into a reservoir and the ink stored in the reservoir continues to be heated while awaiting subsequent use.

Each reservoir of colored, liquid ink may be fluidly coupled to an inkjet printing apparatus. The liquid ink is pumped from the reservoir to a manifold in the inkjet printing apparatus. As the inkjet ejectors in the inkjet printing apparatus eject ink onto a receiving medium or imaging member, the action of the diaphragms in the inkjet ejectors pull ink from the manifold. The inkjet ejectors may be piezoelectric devices that are selectively activated by a controller with a driving signal.

Conduits typically employed in transporting ink between a reservoir and one or more inkjet ejectors may be referred to as "umbilicals". An umbilical may be used as a fluid coupling for transporting liquid ink between an ink supply reservoir and an inkjet printing apparatus. An umbilical may contain one or many separate channels for transporting fluids such as ink. Typical prior art umbilical assemblies include one or more conduits formed from a flexible material, such as extruded silicone, for example. During operation, the channels in the umbilical are filled with ink so as to avoid inserting air bubbles into the inkjet printing apparatus. Air bubbles suspended in ink supplying the inkjet printing apparatus may cause ejector misfires during imaging operations.

During maintenance and cleaning operations, ink within an inkjet printing apparatus may be purged through the inkjet ejectors. A receptacle or catch may be used to capture and hold the purged ink. The receptacle may be emptied after a purge operation by suctioning the ink out of the receptacle through another umbilical to which a negative pressure source has been applied. In prior art printers, the purged ink is discarded after it is removed from the receptacle. The collection and transfer of the purged ink enables more efficient operation of an inkjet printer by allowing the reuse of ink that would otherwise be discarded as waste.

SUMMARY

In one embodiment, an ink reclamation receptacle has been developed. The ink reclamation receptacle includes a gutter having a front wall, a back wall, and a bottom wall that form a volume for ink collection, a membrane positioned within the volume for ink collection to divide the volume for ink collection into a collection reservoir and a flow channel, and a port. The membrane has pores of a predetermined size and a predetermined wettability. The port extends through the back wall to enable fluid communication with the flow channel through the port to enable ink in the volume for ink collection to wet the membrane in response to a portion of the membrane contacting the ink, and to enable a negative pressure established at the port to draw ink from the volume for ink collection through the flow channel to the port.

In another embodiment, an inkjet printing device has been developed. The inkjet printing device includes an inkjet printing apparatus having a plurality of inkjet ejectors, the inkjet printing apparatus being configured to purge ink from the inkjet ejectors, an ink reservoir configured to supply ink to the plurality of inkjet ejectors, a gutter having a front wall, a back wall, and a bottom wall that form a volume for ink collection, a membrane positioned within the volume for ink collection to divide the volume for ink collection into a collection reservoir and a flow channel, and a port extending through the back wall to enable fluid communication with the flow channel through the port. The gutter is positioned proximate to the plurality of inkjet ejectors to receive ink purged through the plurality of inkjet ejectors. The membrane has a plurality of pores having a predetermined size that establishes a first pressure for ink flow through the membrane and a second pressure for air flow through the membrane when the membrane is wetted by ink. The second pressure has a magnitude that is greater than a magnitude of the first pressure.

In another embodiment, an ink reclamation receptacle has been developed. The receptacle includes a gutter having a front wall, a back wall, and a bottom wall that form a volume for ink collection, a dividing wall positioned within the volume for ink collection to divide the volume for ink collection into a collection reservoir and a flow channel, the dividing wall having at least two openings, and a plurality of membranes, each membrane positioned across one opening in the at least two openings in the dividing wall, a port extending through the back wall to enable fluid communication with the flow channel through the port. Each membrane has a plurality of pores having a predetermined size that establishes a first pressure for ink flow through each membrane and a second pressure for air flow through each membrane when each membrane is wetted by ink. The second pressure has a magnitude that is greater than a magnitude of the first pressure.

DETAILED DESCRIPTION

Figure 1A:
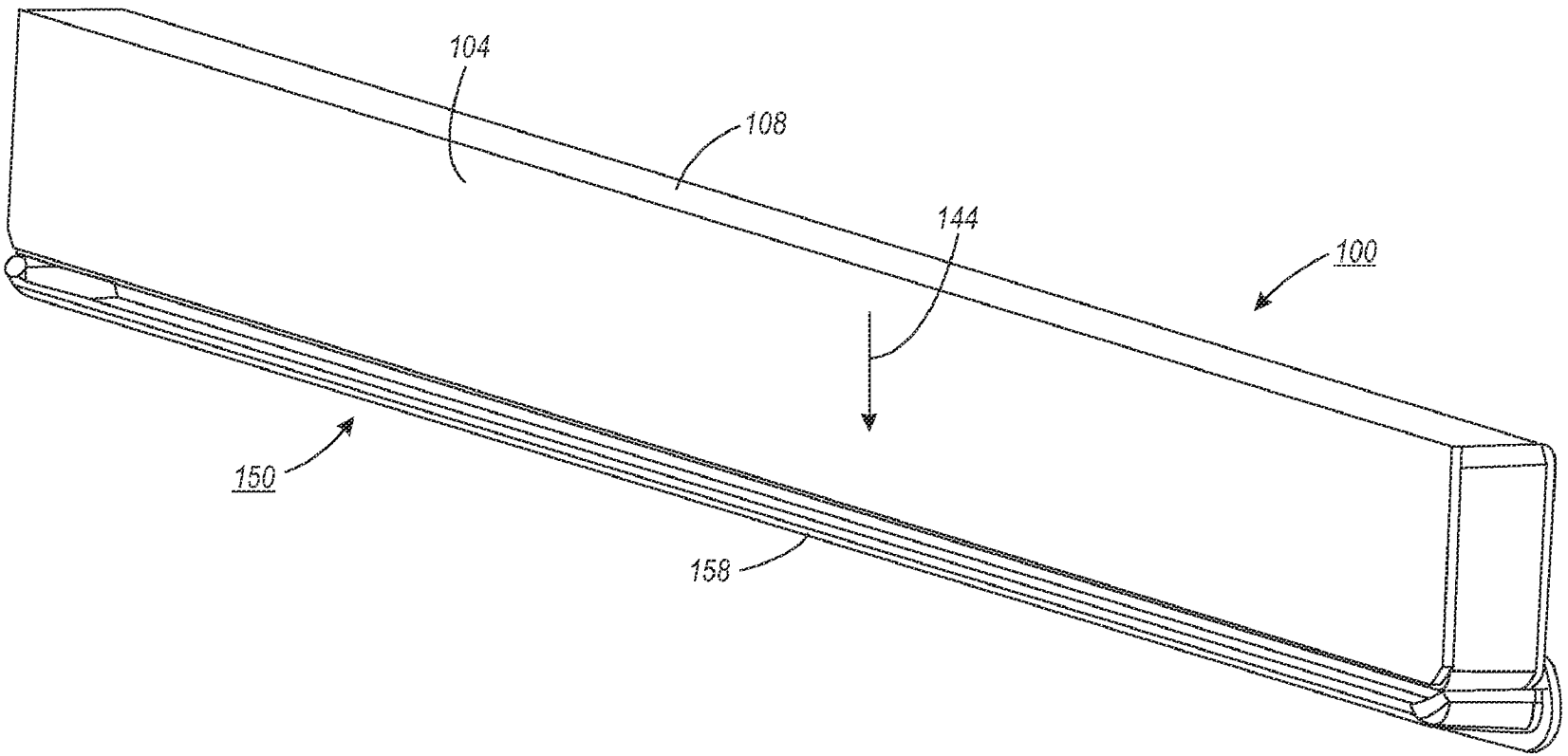
FIG. 1A is a front view of an ink reclamation receptacle that can be operatively connected to an inkjet printing apparatus to collect ink purged from the inkjet printing apparatus.

For a general understanding of the environment for the system and method disclosed herein as well as the details for the system and method, reference is made to the drawings. In the drawings, like reference numerals have been used throughout to designate like elements. As used herein, the term "wettability" refers to a property of a solid material that enables a liquid, such as liquid ink, to spread across a surface of the material. The related term "wetting" refers to a process by which a liquid spreads across the surface of a material when the liquid contacts a portion of the material. In a porous material, the wetting process fills pores in the material with liquid as the liquid spreads. After the liquid fills some or all of the pores in the material, the material is called "wetted." Wettable materials are those materials that enable a liquid to contact a portion of the surface of the material directly and spread across the remaining portion of the surface. A highly wettable material may be referred to as being hydrophilic when contacting aqueous liquids, and lyophilic when contacting non-aqueous liquids. The term "meniscus strength" refers to an attraction of a liquid, such as ink, to a material surrounding an opening in a material, such as a pore in a membrane, positioned across a path for the liquid. The meniscus strength holds the liquid in the pore until a higher magnitude pressure breaks the liquid attraction to the membrane material and pulls gas through the pore. Consequently, a wetted membrane has pores filled with a liquid having a meniscus strength. The wetted pores enable liquids to be pulled through the pores of the membrane while preventing a gas from passing through the membrane when the pressure across the wetted pores remains below the pressure that breaks the meniscus.

The term "conduit" refers to a body having a passageway or lumen through it for the transport of a liquid or a gas. As used herein, a "purge" refers to a maintenance procedure performed by an inkjet printing apparatus to forcibly expel ink from the inkjet ejectors. A purge may be performed by applying air pressure to the inkjet ejectors of the inkjet printing apparatus or by applying suction to the inkjet ejectors. A purge is typically used to remove air bubbles from conduits within the inkjet printing apparatus that form each time phase change ink is melted from solid to liquid. A purge may also be used to clear contaminants from inkjet ejectors. The term "purged ink" refers to ink expelled during a purge operation. The purged ink flows down the face of the inkjet printing apparatus instead of being ejected toward an image receiving surface.

Figure 1B:
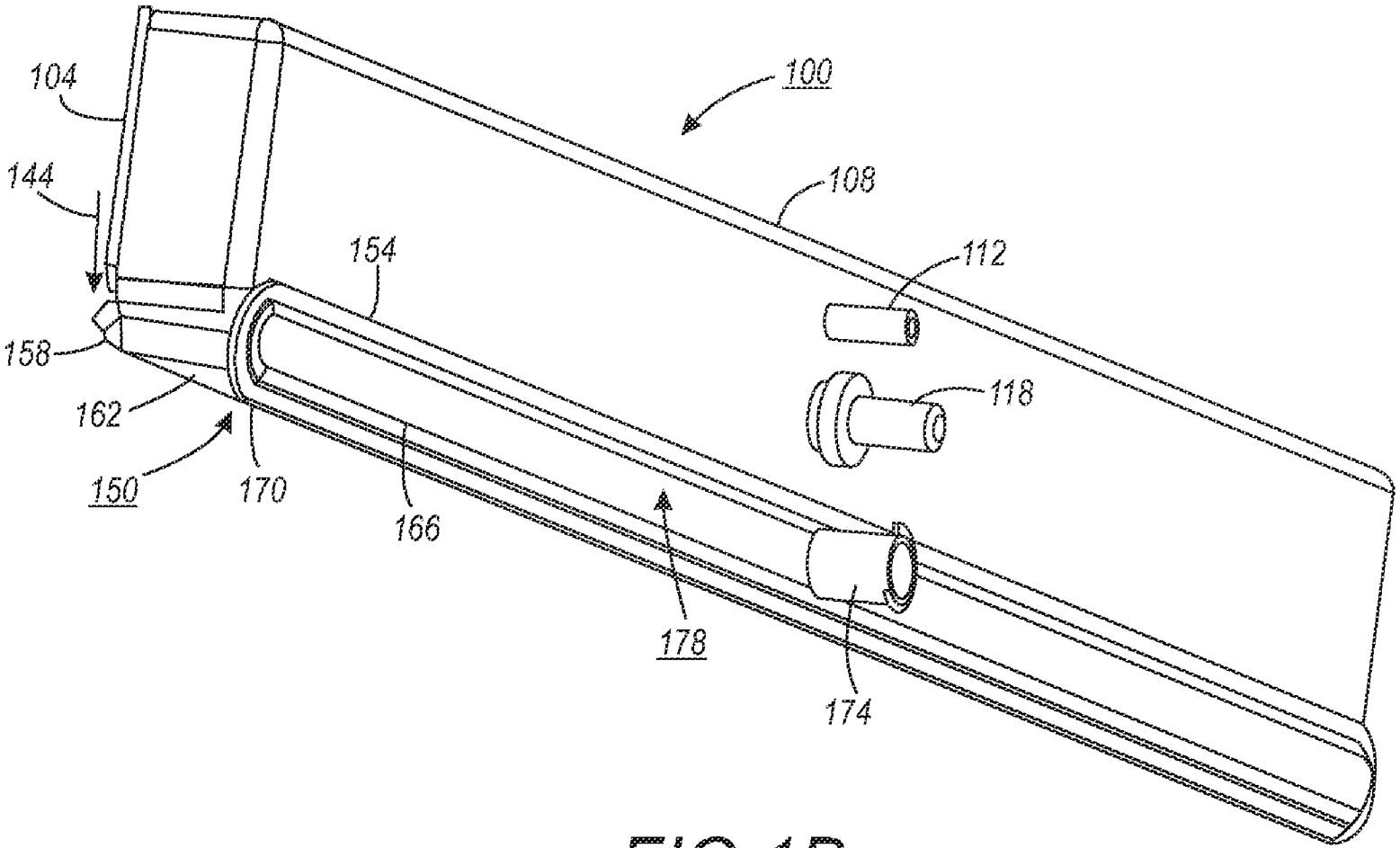
FIG. 1B is a rear view of the ink reclamation receptacle that can be operatively connected to the inkjet printing apparatus to collect ink purged from the inkjet printing apparatus.

FIG. 1A and FIG. 1B depict a front and rear views, respectively, of an inkjet printing apparatus 100 attached to an ink reclamation receptacle 150. Inkjet printing apparatus 100 includes a plurality of inkjet ejectors arranged on a front face 104 of the inkjet printing apparatus. Inkjet printing apparatus 100 may be a full-width apparatus matching a width of an image receiver that receives ink ejected from the plurality of inkjet ejectors, or may cover a partial width of the image receiver. Widths of a printing apparatus 100 may also be wider than the width of the image receiver, such as for employing redundant columns of ink ejectors. A reservoir 108 holds a supply of ink in fluid communication with the plurality of inkjet ejectors. Various embodiments of reservoir 108 and inkjet ejectors may use different inks including phase change inks, aqueous inks, solvent based inks, ultraviolet curable inks and the like. An air vent 112 equalizes pressure in reservoir 108 when the inkjet ejectors are operating, allowing ink held in reservoir 108 to replenish the inkjet ejectors during operation. While air vent 112 of FIG. 1B extends from the rear of inkjet apparatus 100, the vent may be positioned in different locations in alternative embodiments. An ink port 118 allows ink supplied from an external ink supply (not shown) to enter reservoir 108. Ink port 118 may be fluidly connected to a conduit such as a flexible umbilical. Ink port 118 may include a one-way valve such as a check valve to permit ink to enter the reservoir 108 while resisting a flow of ink out of the ink port 118. A negative pressure source may also apply negative pressure to reservoir 108 through ink port 118 in some embodiments.

Ink reclamation receptacle 150 is positioned to collect ink expelled from inkjet printing apparatus 100 during a purge operation, and to return the ink for use in the printing apparatus 100. The ink reclamation receptacle 150 includes a container with a volume for ink collection formed by a front wall 158, bottom wall 162, and back wall 166. The ink reclamation receptacle 150 may further include a top member (omitted for clarity) that covers a portion of the volume for ink collection, and an opening over the volume for ink collection that enables purged ink from the inkjet printing apparatus 100 to flow into the volume for ink collection. The reader should understand that for all configurations sides complete the volume holding capability of the receptacle, for example, by forming or folding part of the bottom or back, or by assembling separate pieces. In the embodiment of FIG. 1A and FIG. 1B, the volume for ink collection in the ink reclamation receptacle 150 is sufficient to hold all ink purged from inkjet printing apparatus 100 during a single purge operation. Front wall 158 extends beyond the front of the front face 104 of inkjet apparatus 100 to allow purged ink to flow down the printing apparatus in direction 144 and enter the ink reclamation receptacle 150. A flow channel 178 extends along the length of the back wall 166. A port 174 extends through back wall 166. Port 174 is in fluid communication with the flow channel 178. In the embodiment of FIG. 1B, port 174 is positioned at the center of back wall 166 equidistant from each end of ink reclamation receptacle 150. As described in more detail below, a negative pressure applied through port 174 may withdraw ink in ink receptacle 150 through the port 174.

The example inkjet printing apparatus 100 and ink reclamation receptacle 150 depicted in FIG. 1A and FIG. 1B depict external views of one embodiment of an inkjet printing apparatus and ink reclamation receptacle. The following figures depict various embodiments of ink reclamation receptacles and combinations of ink reclamation receptacles with inkjet printing apparatuses in more detail.

Figure 2:
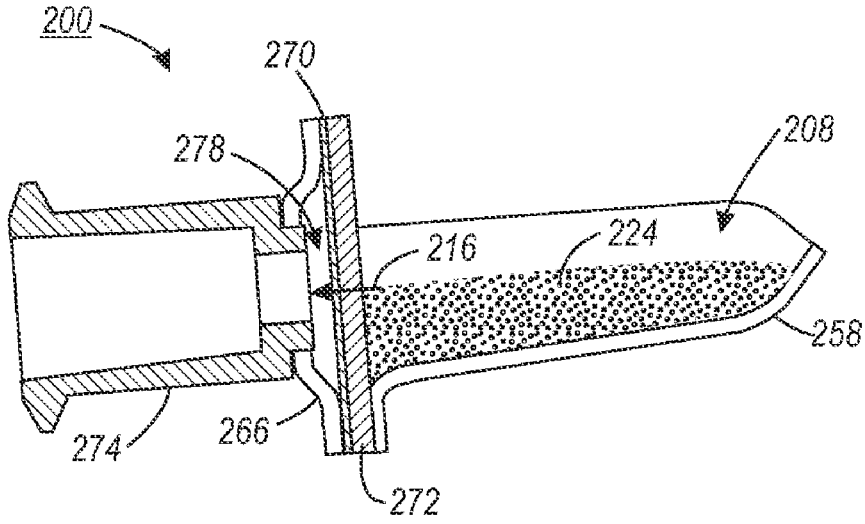
FIG. 2 a is cross-sectional view of an ink reclamation receptacle including a porous membrane vertically oriented in the receptacle.

FIG. 2 depicts one embodiment of an ink reclamation receptacle 200 suitable for collecting and reclaiming ink purged from an inkjet printing apparatus. Ink reclamation receptacle 200 includes a volume for ink collection formed from a front wall 258, bottom wall 262, and back wall 266. In the embodiment of FIG. 2, a single structural member forms front wall 258 and bottom wall 262, although walls in alternative ink receptacles may include separate structural members joined together.

A porous membrane 270 extends through the ink reclamation receptacle 200, dividing the volume for ink collection into a front portion, seen here as collection reservoir 208, and a rear portion, seen here as flow channel 278. In one embodiment, porous membrane 270 is formed from a metallic sheet having a plurality of pores formed through the sheet that are arranged in a substantially two-dimensional configuration. Porous membrane 270 may also be formed from a porous polymer material. Collection reservoir 208 holds purged ink 224. Purged ink 224 may pass through porous membrane 270 into flow channel 278 as shown by arrow 216. The embodiment of FIG. 2 depicts an optional filter layer 272 positioned between the purged ink 224 and the porous membrane 270. The filter layer 272 is formed from a three dimensional matrix of a fibrous material, such as felt, although other filter materials be used. Filter layer 272 is configured to stop particulate contaminants in the purged ink 224 from passing through the layer and blocking pores in the porous membrane 270.

Purged ink 224 wets both the filter layer 272 and porous membrane 270. The materials and configuration of the filter layer 272 and porous membrane 270 are selected to promote wetting of the filter layer 272 and porous membrane 270 by ink 224 in the collection reservoir 208. The wettable filter layer 272 and porous membrane 270 enable purged ink 224 to wet the entire surface area of the porous membrane 270 and filter layer 272 in response to the purged ink 224 contacting a portion of the surface of the filter layer 272 and porous membrane 270. Thus, the ink 224 may wet the pores in membrane 270 even in conditions where the ink would otherwise not contact the pores, such as when ink levels are low or when ink reclamation receptacle 200 tilts at an angle.

In the example of FIG. 2, porous membrane 270 and filter layer 272 are shown with a substantially vertical orientation. As used herein, a vertical orientation means that the porous membrane 270 and filter layer 272 are oriented to be approximately parallel to the back wall 266 in ink reclamation receptacle 200. More generally, a vertical orientation describes an orientation that is generally more parallel than perpendicular to the back wall. An orientation at approximately a 45° angle to either or both of the bottom wall and the back wall may be described as vertical. The membrane and filter are depicted as being flat but other shapes are possible, such as a curved shape that increases exposed surface area.

The ink reclamation receptacle 200 may tilt in a variety of angles during operation. In FIG. 2, ink 224 in the collection reservoir 208 contacts the filter layer 272 and porous membrane 270. When ink wets the pores in the porous membrane 270, surface tension between the ink and the porous membrane 270 forms a meniscus in each pore that resists a flow of air and ink through the wetted pores. The predetermined sizes of pores formed through the membrane 270 enable pressure applied at a first magnitude to draw ink through membrane 270 in direction 216. Pressure applied at a second, larger magnitude, draws air through membrane 270. The meniscus strength of ink 224 wetting the pores of membrane 270 resists air passing through membrane 270 more than ink, establishing a magnitude of pressure required to draw air through membrane 270 that is greater than the magnitude of pressure required to draw ink through the membrane. In the example of FIG. 2, membrane 270 includes pores that are approximately 10 μm in diameter, although alternative membranes may have pores of larger or smaller diameters. Some exemplary embodiments may include pores ranging from 1 μm to 100 μm in diameter. The selected pore size establishes a magnitude of negative pressure for withdrawing ink of approximately 0.1 psi while the magnitude of negative pressure required to withdraw air through the ink meniscuses of the wetted pores is approximately 0.5 psi, although various different inks and pore sizes may result in different meniscus strengths.

In operation, ink drawn through membrane 270 in direction 216 enters flow channel 278. Port 274 is in fluid communication with flow channel 278, and negative pressure may be applied through port 274 and through a conduit (not shown) to reclaim ink from the ink reclamation receptacle 200 through port 274. As described above, a first magnitude of negative pressure is sufficient to withdraw ink in direction 216 through filter layer 272 and porous membrane 270 while also resisting air from flowing through membrane 270. This pressure level prevents air bubbles from forming in reclaimed ink passing through the flow channel 278 and port 274. One example of a pumping apparatus configured to apply the appropriate amount of pressure is a gear pump including a by-pass flow limiter described in further detail in co-pending application Ser. No. 12/847,829, entitled "LIQUID INK DELIVERY SYSTEM INCLUDING A FLOW RESTRICTOR THAT RESISTS AIR BUBBLE FORMATION IN A LIQUID INK RESERVOIR," which was filed on Jul. 30, 2010, and has a common assignee to the present application. Various other sources of negative pressure including peristaltic and reciprocating pumps may also supply an appropriate amount of negative pressure to reclaim ink that is substantially free of air bubbles drawn through membrane 270. One or more inkjet printing apparatuses in fluid communication with the ink reclamation receptacle 200 may use the reclaimed ink.

Figure 3:
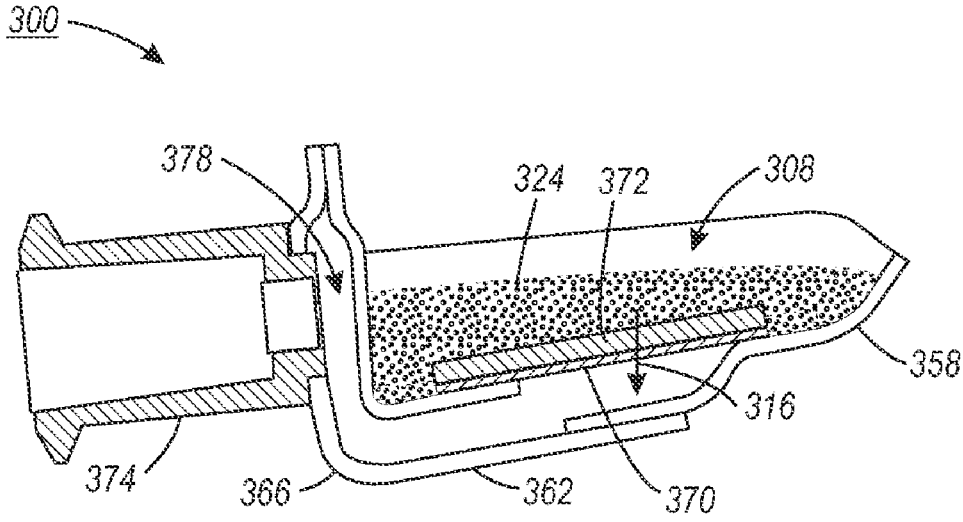
FIG. 3 is a cross-sectional view of an ink reclamation receptacle including a porous membrane horizontally oriented in the receptacle.

An alternative configuration of an ink reclamation receptacle 300 is shown in FIG. 3. Ink reclamation receptacle 300 includes a front wall 358, bottom wall 362, back wall 366, porous membrane 370, filter layer 372, and port 374. Porous membrane 370 separates the volume for ink collection into an upper portion, seen here as collection reservoir 308, and a lower portion, seen here as flow channel 378. As with the embodiment of FIG. 2, ink 324 in the collection reservoir 308 wets the pores in membrane 370 and a sufficient negative pressure may draw ink from the collection reservoir to the flow channel in direction 316. In the embodiment of FIG. 3, membrane 370 is positioned in a horizontal orientation, and filter layer 372 is positioned in the horizontal orientation to prevent contaminants in the ink 324 from blocking pores in the membrane 370. As used herein, a horizontal orientation for the porous membrane means that the porous membrane is oriented to be approximately parallel to the bottom wall 362 in ink reclamation receptacle 300. More generally a horizontal orientation describes an orientation that is generally more parallel than perpendicular to the bottom. An orientation at approximately a 45° angle to either or both of the bottom wall and back wall may be described as horizontal. The porous membrane may occupy various other orientations in the ink reclamation receptacle that permit ink to wet the porous membrane and allow ink to pass through the porous membrane under negative pressure while air is prevented from passing through the porous membrane.

The surface tension of ink 324 draws the ink across the surface of membrane 370 and filter layer 372 and wets the pores formed in membrane 370. Ink 324 may wet the entire surface of membrane 370 even in conditions where the ink 324 would not otherwise contact the entire surface of membrane 370, such as when ink reclamation receptacle 300 tilts at an angle. Similarly to FIG. 2, the meniscus strength of ink 324 wetting the pores of membrane 370 resists air passing through membrane 370 more than ink passing through membrane 370. Air that passes through the membrane forms air bubbles in the reclaimed ink. Therefore, an appropriate level of negative pressure applied through port 374 reclaims ink through flow channel 378 while preventing air bubbles from forming in the reclaimed ink.

Figure 4:
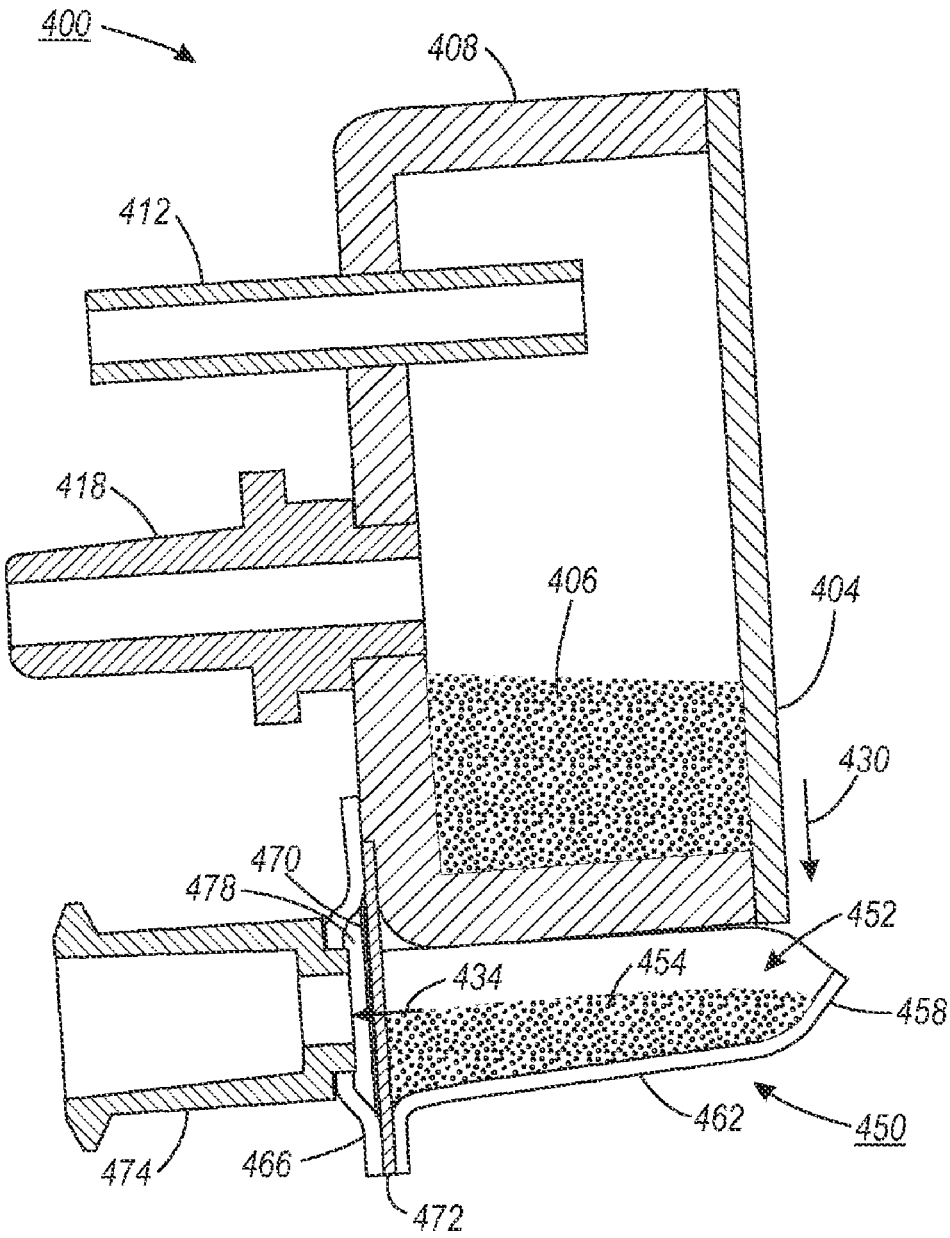
FIG. 4 is a cross-sectional view of an ink reclamation receptacle operatively connected to an inkjet printing apparatus.

FIG. 4 depicts a cross-sectional view of an inkjet printing apparatus 400 that is operatively connected to an ink reclamation receptacle 450. The inkjet printing apparatus 400 includes a plurality of inkjet ejectors 404, an ink reservoir 408, air vent 412, and ink port 418. Air vent 412 extends into the reservoir 408 at a position above ink 406 held in the ink reservoir 408. Ink port 418 enables an external ink supply (not shown) to pump ink into reservoir 408. A conduit such as an ink umbilical or the like may connect ink port 418 to the ink supply. The conduit may be fluidly coupled to a check valve that enables the ink supply to pump ink through the ink port 418 while preventing air and ink in the ink reservoir 408 from entering the conduit. The inkjet printing apparatus 400 periodically purges some or all of ink 406 through the plurality of inkjet ejectors 404, where the purged ink flows down the inkjet printing apparatus 400 into the ink collection receptacle 450 as shown by arrow 430.

The ink reclamation receptacle 450 includes a front wall 458, bottom wall 462, back wall 466, porous membrane 470, filter layer 472, and ink port 474. The front wall 458, bottom wall 462, porous membrane 470 and filter layer 472 form an ink collection reservoir 452 that holds purged ink 454. The back wall 466, porous membrane 470, filter layer 472, form a flow channel 478 that is fluidly coupled to the ink port 474. The ink reclamation receptacle 450 occupies a position that is proximate to the inkjet printing apparatus 400. Front wall 458 extends past the plurality of inkjet ejectors 404 to enable ink purged from the ink reservoir 408 to flow into the ink collection reservoir 452.

In response to negative pressure applied through port 474, purged ink 454 passes through the filter layer 472 and porous membrane 470 in direction 434 into flow channel 478. The reclaimed ink then flows through port 474 to an external ink supply used to supply ink to reservoir 408 through ink port 418. As described above, surface tension of the purged ink 454 wets the filter layer 472 and porous membrane 470 even when the level of purged ink 454 does not cover the entire surface of the filter layer 472 and porous membrane 470. Negative pressure applied through port 474 may reclaim purged ink 454 even when the purged ink only partially fills the collection reservoir 452, or when the purged ink is unevenly distributed such as when the ink reclamation receptacle 450 is tilted at an angle during operation.

Figure 5:
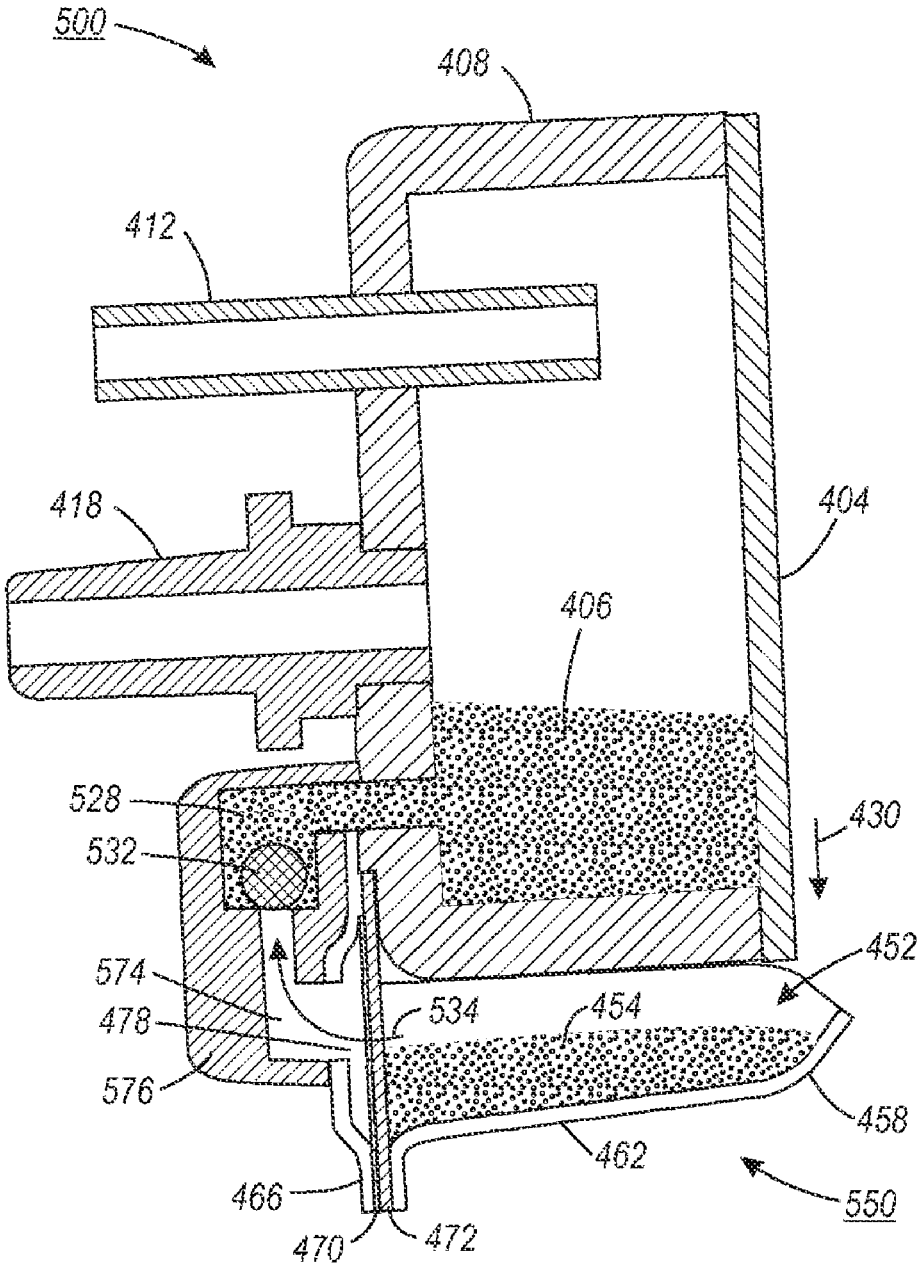
FIG. 5 is a cross-sectional view of an alternative embodiment of an ink reclamation receptacle operatively connected to an inkjet printing apparatus.

FIG. 5 depicts an alternative configuration of an inkjet printing apparatus 500 and an ink reclamation receptacle 550. In FIG. 5, the ink reclamation receptacle 550 is placed in selective fluid communication with the ink reservoir 408. A fluid path 574 extends through back wall 466 to place the flow channel 478 in fluid communication with a one-way valve 528. The fluid path 574 incorporated into a rear housing 576 that is positioned next to the back wall 466 to enable ink to flow from the flow channel 478 in direction 534 to the one-way valve 528. The one-way valve 528 is in further fluid communication with the ink reservoir 408. One-way valve 528 is shown here as a check valve including a ball 532 that is biased in a closed position by gravity, resisting a flow of ink 406 in the ink reservoir 408 into the ink reclamation receptacle 550 through the one-way valve 528.

In operation, negative pressure applied through air vent 412 forms a partial vacuum in ink reservoir 408. A check valve (not shown) may temporarily close ink port 418 while the negative pressure is applied to assist in forming the partial vacuum in the ink reservoir 408. In an alternative configuration, the negative pressure may be applied through the ink port 418 and a solenoid (not shown) may seal the air vent 412 to form the partial vacuum in the ink reservoir 408. The partial vacuum urges ball 532 out of the closed position, and applies negative pressure to flow channel 478 through the fluid path 574. Purged ink 454 held in collection reservoir 452 flows in direction 534 through filter layer 472, membrane 470, flow channel 478, fluid path 574, and one-way valve 528. Reclaimed ink subsequently enters the ink reservoir 408, where the ink 406 is available for printing through inkjet ejectors 404. One-way valve 528 closes in the absence of negative pressure, resisting a flow of ink 406 from the ink reservoir 408 into the ink reclamation receptacle 550. The magnitude of negative pressure applied air vent 412 is sufficient to open one-way valve 528, and to pump ink from the ink reclamation receptacle into the reservoir 408 while also being small enough to prevent air from passing through membrane 470 with the reclaimed ink.

FIG. 4 and FIG. 5 depict two exemplary configurations of inkjet printing apparatuses that are operatively connected to an ink reclamation receptacle. Any of the various ink reclamation receptacles embodied herein or ink reclamation receptacles that would function in a similar manner may be positioned to collect and reclaim ink purged from an inkjet printing apparatus. In another configuration, the ink reclamation receptacle may be mounted separately from the inkjet printing apparatus. When mounted separately, the ink reclamation receptacle and inkjet printing apparatus may selectively engage each other during purge operations to enable the inkjet printing apparatus to purge ink into the ink reclamation receptacle. The ink reclamation receptacle and inkjet printing apparatus may disengage during imaging operations.

Figure 6:
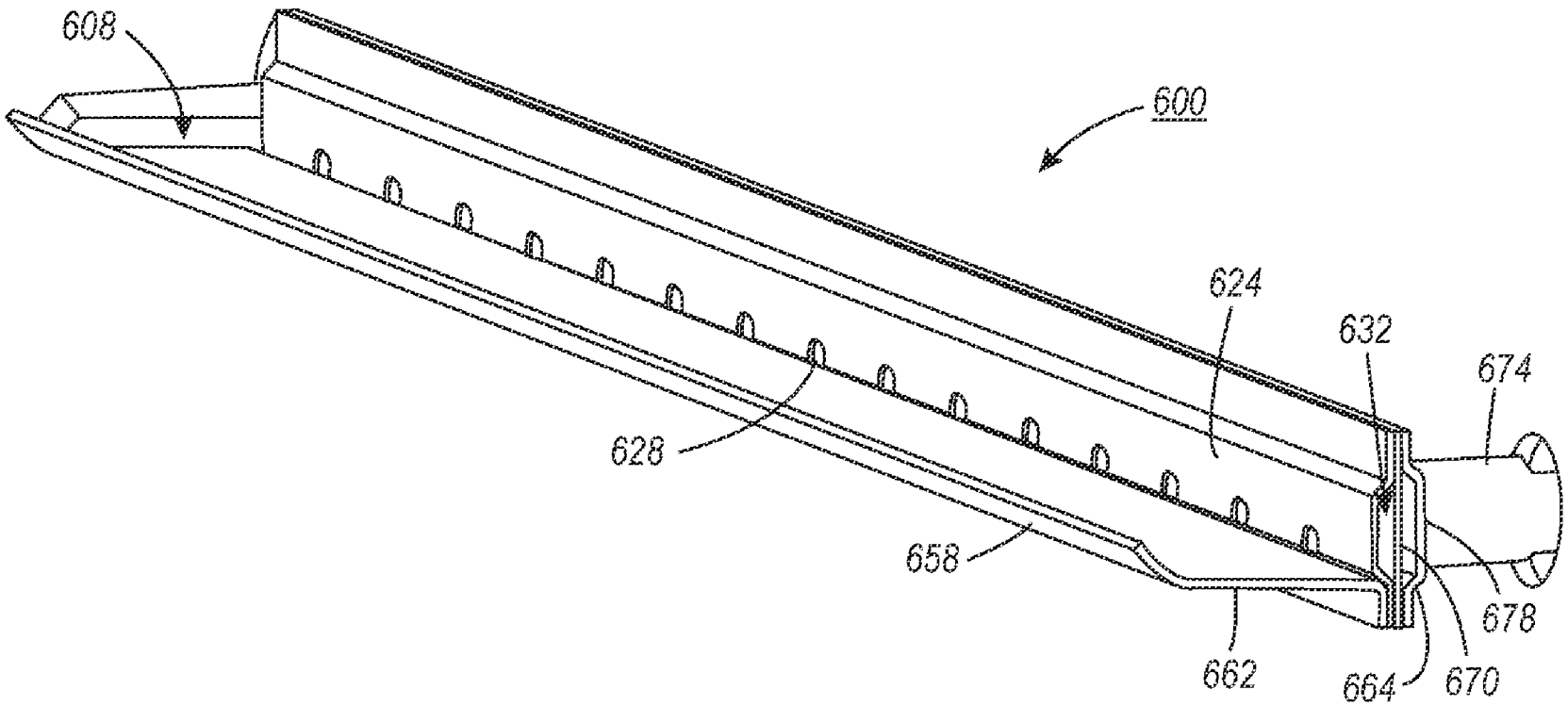
FIG. 6 is a cut-away view of an ink reclamation receptacle including a wall with holes positioned adjacent to a porous membrane.

FIG. 6 depicts another embodiment of an ink reclamation receptacle 600. Similar to the ink reclamations receptacles described above, ink reclamation receptacle 600 includes a volume for ink collection formed by front wall 658, bottom wall 662, and back wall 664, with a porous membrane 670 dividing the volume for ink collection into a collection reservoir 608 and flow channel 678. A port 674, seen here positioned at one end of ink reclamation receptacle 600, extends through back wall 664 and may apply a negative pressure to reclaim ink held in the ink reclamation receptacle. The embodiment of FIG. 6 includes an additional wall 624 positioned adjacent to the membrane 670 in the ink collection reservoir 608. Wall 624 includes a plurality of holes such as hole 628 that allows ink held in the collection reservoir 608 to flow into a space 632, shown here in a cut away view, formed between the wall 624 and the porous membrane 670. The size and shape of space 632 are selected to promote ink adhering to the porous membrane 670 and the side of wall 624 facing the porous membrane 670. As described above, surface tension between ink held in the collection reservoir 608 and the membrane enables the ink to wet pores in the membrane, 670 even when the level of ink in the ink collection reservoir 608 is below the full height of the membrane 670. Wall 624 promotes the wetting process by providing an additional surface for ink to adhere to as the ink contacts membrane 670. Capillary action of the ink between both wall 624 and membrane 670 urges the ink upwards from the bottom wall 662, allowing the ink to wet the entire height of porous membrane 670. Ink reclamation receptacle 600 may operate in a similar manner to the foregoing ink reclamation receptacles. The wall 624 including holes 628 depicted in FIG. 6 may be combined with other ink reclamation receptacle embodiments, including the exemplary embodiments shown in FIG. 2-FIG. 3 and FIG. 7-9.

Figure 7:
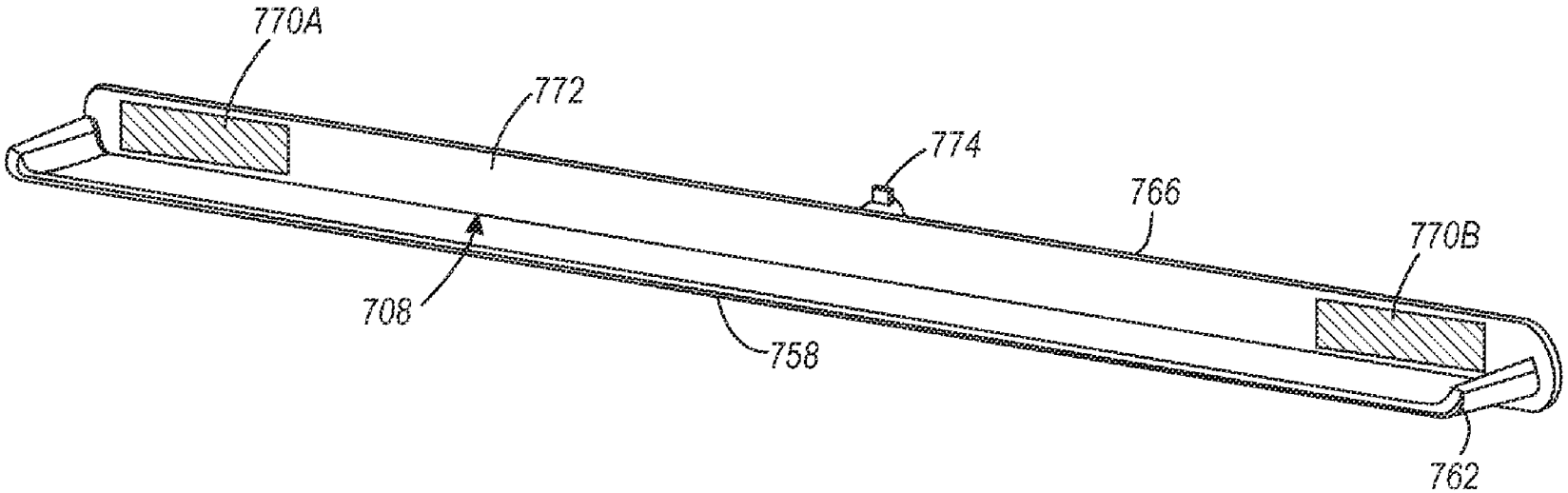
FIG. 7 is a view of an ink reclamation receptacle including two porous membranes positioned in the receptacle.

FIG. 7 depicts another embodiment of an ink reclamation receptacle 700 including a front wall 758, bottom wall 762, and back wall 766. Ink reclamation receptacle 700 includes two porous membranes 770A and 770B positioned in openings of a dividing wall 772 that separates the ink collection reservoir 708 from the flow channel (not shown). The solid portions of dividing wall 772 are substantially impermeable to ink and air, and membranes 770A and 770B cover a partial width of the ink reclamation receptacle 700. The openings of dividing wall 772 and membranes 770A and 770B occupy positions at each end of dividing wall 772.

Ink held in ink collection reservoir 708 wets both of porous membranes 770A and 770B, allowing negative pressure applied through port 774 to reclaim ink held in the ink reclamation receptacle 700. After the porous membranes 770A and 770B are wetted, ink may pool in contact with one or the other membrane in situations where the ink reclamation receptacle tilts at an angle. The pooled ink is reclaimed through one of membranes 770A and 770B positioned at either end of dividing wall 772. Various modifications of ink reclamation receptacle 700 may include additional openings with porous membranes, and may position membranes at various locations along the dividing wall. The dividing wall 772 may be oriented vertically, horizontally, or at any other angle that allows reclamation of ink held in the ink collection receptacle through port 774. Other ink receptacle embodiments may include two or more porous membranes, including the exemplary embodiments shown in FIG. 2-FIG. 3, FIG. 6, and FIG. 8-9.

Figure 8:
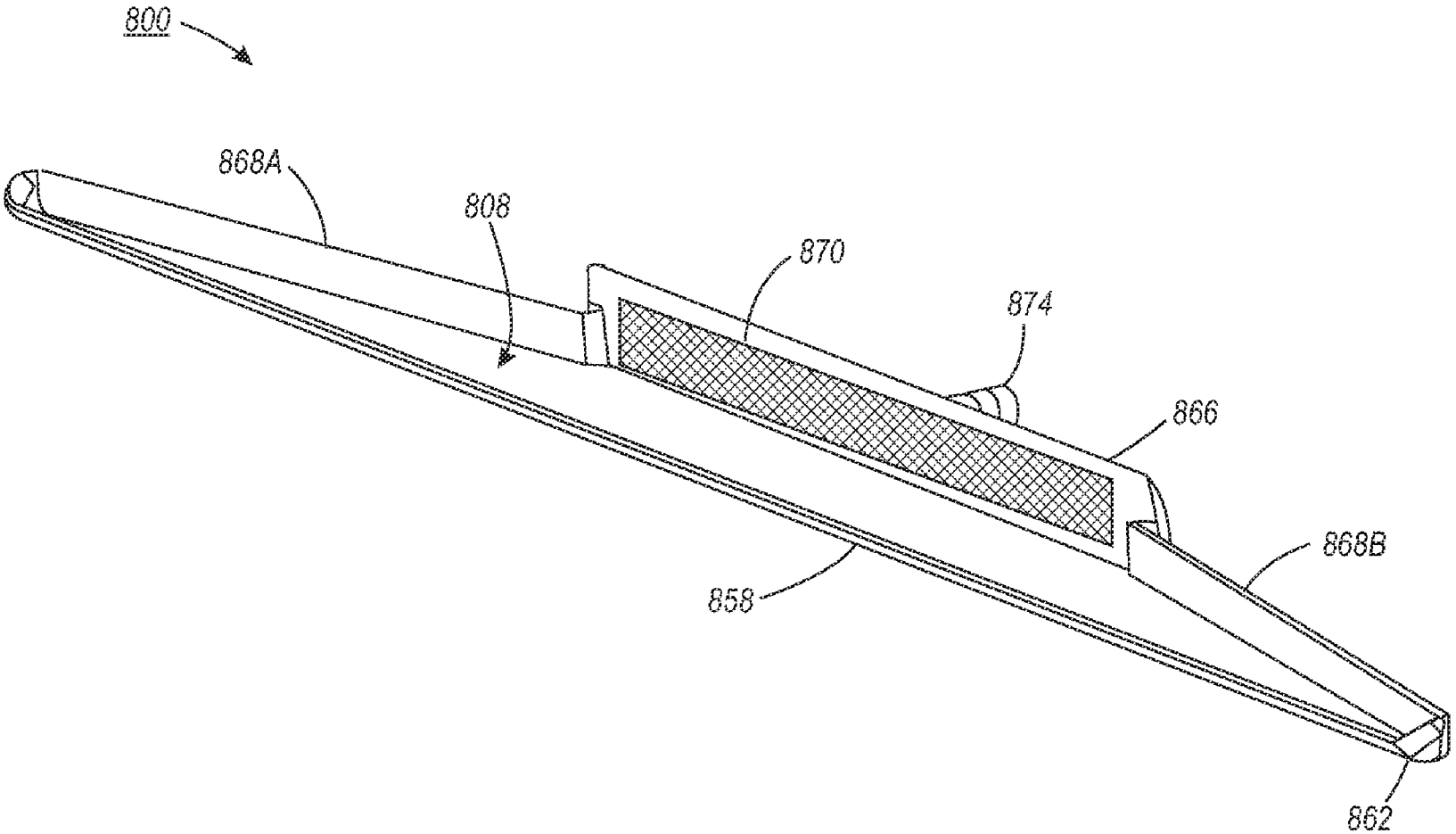
FIG. 8 is a view of an ink reclamation receptacle including angled back walls.

FIG. 8 depicts another embodiment of an ink reclamation receptacle 800 including a front wall 858, bottom wall 862, back wall 866, porous membrane 870, and port 874. Ink reclamation receptacle 800 includes two angled back walls 868A and 868B that extend outwardly from either lateral end of the back wall 866 toward the lateral ends of the front wall 858. The front wall 858, bottom wall 862, back wall 866, and angled walls 868A-868B form an ink collection reservoir 808. The ink collection reservoir 808 is configured to hold purged ink that passes through the porous membrane 870 to a flow channel (not shown) in fluid communication with the port 874. The angled walls 868A and 868B in the ink reclamation receptacle 800 are configured to guide purged ink in the collection reservoir 808 toward the membrane 870 and port 874. In one configuration, the ink reclamation receptacle 800 is oriented with the port 874 positioned below the front wall 858 to enable gravity to urge ink toward the port 874 as the angled walls 868A and 868B guide the flow of ink toward port 874. The purged ink flows toward porous membrane 870, and the porous membrane 870 may have a shorter width than in alternative embodiments to enable the collected ink to flow to the port 874. The angled wall configured depicted in FIG. 8 may be combined with other ink reclamation receptacle embodiments, including the exemplary embodiments shown in FIG. 2-FIG. 3, FIG. 6-7, and FIG. 9.

Figure 9:
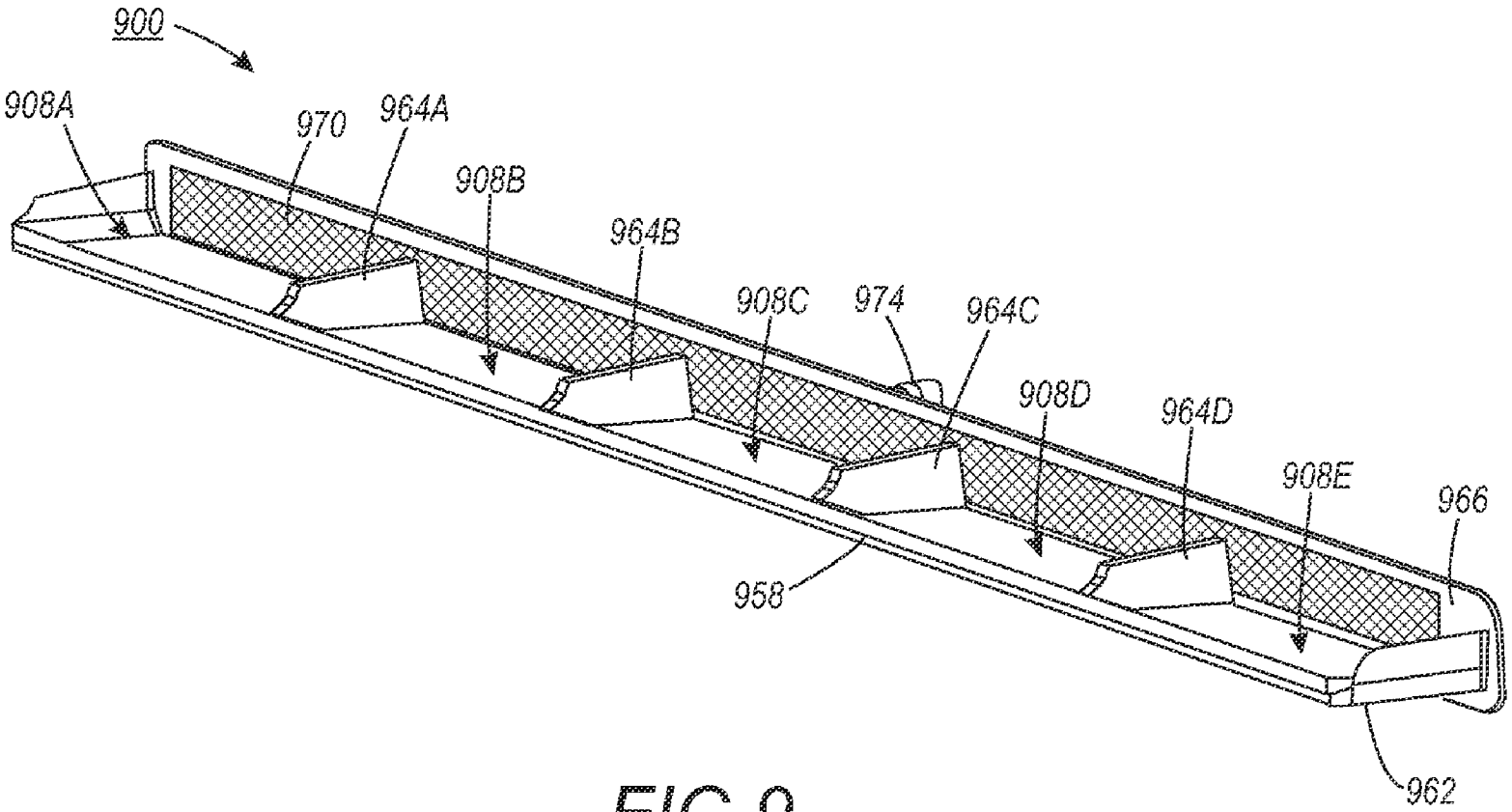
FIG. 9 is a view of an ink reclamation receptacle including baffle members.

FIG. 9 depicts another embodiment of an ink reclamation receptacle 900 including a front wall 958, bottom wall 962, back wall 966, porous membrane 970, and port 974. The embodiment of FIG. 9 includes baffle members 964A, 964B, 964C and 964D that are arranged between the porous membrane 970 to the front wall 958. The baffle members 964A-964D, front wall 958, bottom wall 962, and back wall 966 form a plurality of separate ink collection reservoirs 908A, 908B, 908C, 908D, and 908E. Each of the ink collection reservoirs 908A-908E is configured to hold purged ink that passes through the porous membrane 970 to a flow channel (not shown) in fluid communication with the port 974. While FIG. 9 depicts a single porous membrane 970, another ink reclamation receptacle configuration may include separate porous membranes for one or more of the ink reclamation receptacles.

The baffle members 964A-964D between the ink collection reservoirs 908A-908E restrict the flow of ink in a lateral direction through the ink reclamation receptacle 900. When the ink reclamation receptacle 900 tilts at an angle, ink may flow toward one end of the ink reclamation receptacle 900. The baffle members 964A-964D limit the distance that ink may flow laterally. While FIG. 9 depicts four baffle members 964A-964D, alternative configurations may use a lower or higher number of baffle members arranged in different positions to form separate ink collection reservoirs. The baffle members may also be combined with other ink reclamation receptacle embodiments, including the exemplary embodiments shown in FIG. 2-FIG. 3 and FIG. 6-8.

It will be appreciated that variants of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. A drop on-demand inkjet device comprising:

an inkjet printing apparatus having a plurality of inkjet ejectors, the inkjet printing apparatus being configured to purge ink from the inkjet ejectors;

an ink reservoir configured to supply ink to the plurality of inkjet ejectors;

a gutter having a front wall, a back wall, and a bottom wall that form a volume for ink collection, the gutter being positioned proximate to the plurality of inkjet ejectors to receive ink purged through the plurality of inkjet ejectors;

a membrane positioned within the volume for ink collection to divide the volume for ink collection into a collection reservoir and a flow channel, the membrane having a plurality of pores having a predetermined size that establishes a first pressure for ink flow through the membrane and a second pressure for air flow through the membrane when the membrane is wetted by ink, the second pressure having a magnitude that is greater than a magnitude of the first pressure; and a port extending through the back wall to enable fluid communication with the flow channel through the port.

2. The device of claim 1 wherein the port is positioned between a first end and a second end of the back wall.

3. The device of claim 1 wherein the membrane is oriented vertically within the volume for ink collection.

4. The device of claim 3 further comprising:

a wall positioned within the collection reservoir adjacent to the membrane, the wall including at least one hole that enables ink to flow between the wall and the membrane.

5. The device of claim 4 wherein the wall and the membrane are separated by a distance that enables surface tension of the ink between the wall and the membrane to wet a height of the membrane.

6. The device of claim 1, the membrane having a width that corresponds to a width of the plurality of inkjet ejectors in a cross-process direction.

* * * * *